US007410565B1

(12) United States Patent
Lapinski et al.

(10) Patent No.: US 7,410,565 B1
(45) Date of Patent: Aug. 12, 2008

(54) MULTI-CATALYST SELECTION FOR CHLORIDED REFORMING CATALYST

(75) Inventors: Mark P. Lapinski, Aurora, IL (US); Leon Yuan, Lake Forest, IL (US); Mark D. Moser, Elk Grove Village, IL (US)

(73) Assignee: UOP LLC, Des Plaines, IL (US)

( * ) Notice: Subject to any disclaimer, the term of this patent is extended or adjusted under 35 U.S.C. 154(b) by 565 days.

(21) Appl. No.: 11/015,156

(22) Filed: Dec. 17, 2004

(51) Int. Cl.
*C10G 35/04* (2006.01)

(52) U.S. Cl. ..... 208/63

(58) Field of Classification Search ..... 208/63, 208/210, 65, 212
See application file for complete search history.

(56) References Cited

U.S. PATENT DOCUMENTS

| | | | | |
|---|---|---|---|---|
| 2,890,167 | A | 6/1959 | Haensel | 208/139 |
| 2,892,858 | A | 6/1959 | Ziegler | 260/448 |
| 3,287,253 | A | 11/1966 | McHenry, Jr. et al. | 208/65 |
| 3,647,680 | A | 3/1972 | Greenwood et al. | 208/65 |
| 3,652,231 | A | 3/1972 | Greenwood et al. | 23/288 G |
| 3,692,496 | A | 9/1972 | Greenwood et al. | 23/288 G |
| 3,846,283 | A | 11/1974 | Rausch | 208/139 |
| 3,852,190 | A | 12/1974 | Buss et al. | 208/138 |
| 3,864,240 | A | 2/1975 | Stone | 208/64 |
| 4,012,313 | A | 3/1977 | Buss et al. | 208/139 |
| 4,306,963 | A | 12/1981 | Johnson | 208/139 |
| 4,483,767 | A | 11/1984 | Antos et al. | 208/138 |
| 4,741,820 | A * | 5/1988 | Coughlin et al. | 208/138 |
| 4,832,821 | A | 5/1989 | Swan, III | 208/65 |
| 4,832,921 | A | 5/1989 | Greenwood | 422/223 |
| 4,929,794 | A * | 5/1990 | Schmidt et al. | 585/737 |
| 5,196,110 | A * | 3/1993 | Swart et al. | 208/65 |
| 5,837,636 | A | 11/1998 | Sechrist et al. | 502/35 |
| 5,972,820 | A | 10/1999 | Kharas et al. | 501/127 |
| 6,558,532 | B1 | 5/2003 | Lin et al. | 208/134 |
| 2004/0209771 | A1 * | 10/2004 | Abe et al. | 502/313 |
| 2007/0215523 | A1 * | 9/2007 | Moser et al. | 208/133 |

OTHER PUBLICATIONS

AM-96-50, "IFP Solutions for Revamping Catalytic Reforming Units", J.L. Gendler et al, NPRA Annual Meeting, Mar. 17-19, 1996, San Antonio, TX.

AM-03-93, "Platforming™ Technology Advances: CycleX™ System for Increased Hydrogen Production from a Fixed-Bed Reforming Unit", S.T. Peters, NPRA Annual Meeting, Mar. 23-25, 2003, San Antonio, Tx.

* cited by examiner

*Primary Examiner*—Walter D. Griffin
*Assistant Examiner*—Francis C Campanell
(74) *Attorney, Agent, or Firm*—Maryann Maas

(57) ABSTRACT

The chloride retention of an alumina catalyst over the course of operation and regeneration can be controlled and stabilized by incorporating a small amount of a component selected from the group including phosphorus, boron, titanium, silicon, and zirconium. Steam treatments have been used to simulate commercial hydrothermal stability and a small amount of the stabilizer component has been discovered which balances chloride retention. Moreover, in a multi-catalyst hydrocarbon conversion process, such as the two-step reforming of naphtha, it has been discovered that proper selection of a catalyst having lower chloride retention in combination with another catalyst having higher chloride retention results in a process with increased yield and/or higher octane gasoline.

23 Claims, No Drawings

MULTI-CATALYST SELECTION FOR CHLORIDED REFORMING CATALYST

FIELD OF THE INVENTION

This invention relates to a catalytic naphtha reforming process using at least two different reaction conditions and a reforming catalyst system using at least two different catalysts. Process and catalyst performance is improved with differential halogen retention levels between catalysts.

BACKGROUND OF THE INVENTION

Catalytic reforming of naphtha involves a number of competing processes or reaction sequences. These include dehydrogenation of cyclohexanes to aromatics (benzene), dehydroisomerization of alkylcyclopentanes to alkylaromatics, dehydrocyclization of an acyclic hydrocarbon to aromatics, hydrocracking of paraffins to light products boiling outside the gasoline range, dealkylation of alkylbenzenes and isomerization of paraffins. Some of the reactions occurring during reforming, such as hydrocracking which produces light paraffin gases, have a deleterious effect on the yield of products boiling in the gasoline range. Process improvements in catalytic reforming thus are targeted toward enhancing those reactions effecting a higher yield of the gasoline fraction at a given octane number.

It is important that a catalyst exhibits the capability both to initially perform its specified functions efficiently and to perform them satisfactorily for prolonged periods of time. The parameters used in the art to measure how well a particular catalyst performs its intended function in a particular hydrocarbon reaction environment are activity, selectivity and stability. In a reforming environment, these three parameters are defined as follows: (1) Activity is a measure of the ability of the catalyst to convert hydrocarbon reactants to products at a designated severity level, with severity level representing a combination of reaction conditions: temperature, pressure, contact time, and hydrogen partial pressure. Activity typically is characterized as the octane number of the pentanes and heavier ("$C_5^+$") product stream from a given feedstock at a given severity level or conversely as the temperature required to achieve a given octane number. (2) Selectivity refers to the percentage yield of petrochemical aromatics or $C_5^+$ gasoline product from a given feedstock at a particular activity level. (3) Stability refers to the rate of change of activity or selectivity per unit of time or of feedstock processed. Activity stability generally is measured as the rate of change of operating temperature per unit of time or of feedstock to achieve a given $C_5^+$ product octane, with a lower rate of temperature change corresponding to better activity stability, since catalytic reforming units typically operate at relatively constant product octane. Selectivity stability is measured as the rate of decrease of $C_5^+$ product or aromatics yield per unit of time or of feedstock. Hydrothermal stability refers to the ability of a catalyst to withstand extended conditions associated with commercial operation and periodic regeneration to remove accumulated coke deposits. Coke deposits are a well-known cause of catalyst deactivation and are typically removed through exothermic combustion. Such periodic regeneration most frequently results in surface area decline and reduced support capacity to hold anions such as chloride. Thus, a steam treatment test to study surface area decline can be useful in simulating long-term hydrothermal stability over prolonged periods of time.

Programs to improve performance of reforming catalysts are being stimulated by the reformulation of gasoline and related refinery demands for constant hydrogen supply. Gasoline-upgrading processes such as catalytic reforming must operate at higher efficiency with greater flexibility in order to meet these changing requirements. The major problem facing workers in this area of the art, therefore, is to develop catalysts with more stability, activity, and selectivity.

U.S. Pat. No. 2,890,167 to Haensel broadly discloses a gasoline reforming process in the presence of a catalyst containing a platinum group metal and a phosphorus component.

U.S. Pat. No. 4,306,963 to Johnson discloses a thermally stabilized halide-promoted, supported noble metal reforming catalyst that uses a minor amount of silica with a mull of alumina prior to extrusion and calcination.

U.S. Pat. No. 4,483,767 to Antos et al. discloses reforming over a catalyst having a platinum group composition and also containing phosphorus. Such a catalyst shows best results with about 0.5 wt-% phosphorus and about 1.0 wt-% chloride on gamma-alumina.

U.S. Pat. No. 5,972,820 to Kharas et al. discloses methods of stabilizing crystalline delta phase alumina compositions, including specific compositions with an effective lower limit of 1.0 wt-% phosphorus, silicon, germanium, or arsenic oxides.

Moreover, a catalytic reforming process with a chlorided catalyst that can effectively retain sufficient chloride has longer over-all life with reduced chloride consumption (and consequent corrosion resistance) and improved economics than a chlorided catalyst with excess stabilizing component that cannot retain sufficient chloride. Over-all life of a reforming catalyst is typically considered to be near the end of its useful life once the surface area has declined below 150 $m^2/g$. Excessive chloride consumption occurs with lower levels of surface area where catalysts lose part of their ability to retain chloride species, and thus a minimum useful chloride retention level for a reforming catalyst is typically considered to be about 0.8 wt-%. Such chloride provides acidity function to the catalyst which facilitates isomerization and cracking reactions which participate in allowing the catalyst to transform a low octane feed into a high octane product.

As heretofore mentioned, processes of catalytic reforming continue to be developed that utilize improved catalysts for the increased economical production of gasoline and hydrogen. Control of catalyst acidity is an important part of such processes.

U.S. Pat. No. 3,287,253 to McHenry, Jr. et al. discloses a selection and use of three specific catalysts in three zones to provide an improved naphtha reforming process. The first catalyst has low halogen retention in order to avoid formation of cracking sites by using a non-acidic support, while the second catalyst has an acidic support such as silica-alumina, and the third and final catalyst has a platinum-alumina-chloride complex. Chloride injection and removal is disclosed around the third stage catalyst.

U.S. Pat. No. 3,846,283 to Rausch discloses a catalytic reforming process for a gasoline fraction with a bimetallic catalyst having a platinum group component, a tin component, and a halogen component that uses a halogen additive in an amount of about 0.1 to 100 wt-ppm of the gasoline fraction.

U.S. Pat. No. 3,864,240 to Stone discloses an integrated system with a fixed-bed catalyst system and a movable, gravity-flowing catalyst system. The movable catalyst is subjected to a chlorination zone when it moves into a regeneration section. This system is similar to the integrated systems disclosed in AM-96-50, "IFP Solutions for Revamping Catalytic Reforming Units" by Gendler et al. This system is also similar to the integrated system disclosed in AM-03-93, "PLAT- FORMING Technology Advances: CYCLEX System for Increased Hydrogen Production from a Fixed-Bed Reforming Unit" by Peters.

U.S. Pat. No. 4,832,821 to Swan discloses a catalytic reforming process where the level of halide in a multiple reactor system is maintained in each reactor by injecting into each reactor a mixture of water and halide at a ratio of 20:1 to 60:1.

U.S. Pat. No. 5,837,636 to Sechrist discloses a method of reducing chloride emissions from a catalyst regeneration process used with catalytic reforming by sorbing a portion of the chlorides from an effluent stream onto catalyst particles. The method captures and returns to the process the chlorides that would be lost to the process and that would need to, be replaced by the injection of make-up chlorides.

U.S. Pat. No. 6,558,532 to Lin et al. discloses periodically contacting a reforming catalyst with an organic chloride in an effective amount to restore at least a portion of catalyst activity.

SUMMARY OF THE INVENTION

Applicants have discovered a way to advantageously tailor the chloride retention capability of fresh catalysts based on positional design in a multiple reaction zone system by using effective amounts of stabilizer components composited within at least one of at least two different catalysts. Multizone hydrocarbon conversion processes often take place under conditions exposing catalysts to varying chloride environments. Consequently, an object of this invention is a catalyst system with at least two selected catalysts with different chloride retention capabilities. Another object of this invention is an improved process using the multiple catalyst system, preferably a catalytic naphtha reforming process. Accordingly, a first selected catalyst is based upon at least one alumina support having at least one stabilizer component such as phosphorus, boron, titanium, silicon, zirconium, in an amount greater than 0 wt-% and less than 1 wt-%. Preferably the stabilizer content of the first catalyst varies from about 0.05 wt-% to about 0.5 wt-%. A second catalyst, different from the first catalyst, having an optional stabilizer component is also further characterized in that after hydrothermal steaming of fresh catalyst with air at 40 mol-% water for 6 hours at 725° C., the catalyst retains an equilibrium level of chloride adsorption greater than 0.8 wt-% upon chloride treatment.

In order to be effective as a reforming catalyst system, this invention will have a platinum group component, an optional metal modifier component, and a halogen component. The catalyst should also contain alumina. Therefore, a reforming process using the catalyst system will comprise contacting a naphtha feedstock with at least two different catalysts under reforming conditions to provide an aromatized product with increased octane over the feedstock.

Additional objects, embodiments and details of this invention can be obtained from the following detailed description of the invention.

DETAILED DESCRIPTION OF THE INVENTION

The present invention relates to a catalyst system comprising at least two independent and different catalysts with optional stabilizing components to control chloride retention. Each catalyst comprises a support having dispersed thereon at least one platinum group metal component and optionally a modifier metal such as rhenium. The support can be any of a number of well-known supports in the art including aluminas, and alumina blended and/or composited with a stabilizing component including, for example, silica/alumina, titania/alumina, and zirconia/alumina. The aluminas which can be used as support include gamma alumina, theta alumina, delta alumina, and alpha alumina with gamma alumina being preferred. Included among the aluminas are aluminas that contain small amounts the stabilizing components such as boron, zirconium, titanium and phosphate. The supports can be formed in any desired shape such as spheres, pills, cakes, extrudates, powders, granules, etc. and they may be utilized in any particular size. The description that follows will be directed to phosphorus as a stabilizing component, but similar methods and techniques well-known in the art will apply to substituting other stabilizing components such as boron. As mentioned previously, the elements of silicon, titanium, and zirconium can also be composited as oxides blended with the alumina support, or they may be composited as other salts, such as chlorides, or composited in the reduced state, via methods such as impregnation or ion-exchange or other techniques well-known in the art. The stabilizer component will be present in at least the first catalyst of the catalyst system of the invention in an amount greater than 0 wt-% and less than 1 wt-%. Preferably the stabilizer content of the first catalyst varies from about 0.05 wt-% to about 0.5 wt-%. Most preferably the stabilizer content of the first catalyst will be between 0.05 wt-% to 0.35 wt-%. A second catalyst of the invention may optionally contain a stabilizing component, or may forgo the stabilizing component.

A critical aspect of the invention is that the second catalyst will have a different amount of stabilizer component, that will range from an absent component at 0 wt-% to any amount up to and exceeding 1 wt-%, with the sole limitation being that the second catalyst have an effective amount different from the first catalyst that provides a different chloride retention. An effective amount will be recognized as different by any significant amount, which in many cases will be as little as 0.2 wt-% different from the first catalyst. The second catalyst having the optional stabilizer component is characterized in that after hydrothermal steaming of fresh catalyst with air at 40 mol-% water for 6 hours at 725° C., the second catalyst retains an equilibrium level of chloride adsorption greater than 0.8 wt-% upon chloride treatment. Fresh catalyst refers to catalyst that has not yet been used in a reforming process or to catalyst with an initial surface area ranging between about 250 $m^2/g$ and about 185 $m^2/g$ or to catalyst prior to steaming. In all cases, the surface area of the catalysts will be greater than about 130 $m^2/g$; with a surface area greater than about 150 $m^2/g$ being preferred for effective use in a reforming process.

One way of preparing a spherical alumina support with a small amount of phosphorus is based on the well known oil drop method which is described in U.S. Pat. No. 2,620,314, which is incorporated by reference. The oil drop method comprises forming an aluminum hydrosol by any of the techniques taught in the art and preferably by reacting aluminum metal with hydrochloric acid and a small amount of phosphoric acid; combining the hydrosol with a suitable gelling agent; and dropping the resultant mixture into an oil bath maintained at elevated temperatures. Boric acid may be substituted for phosphoric acid in part or in whole. The droplets of the mixture remain in the oil bath until they set and form hydrogel spheres. Such spheres are defined as substantially spherical. The spheres are then continuously withdrawn from the oil bath and typically subjected to specific aging and drying treatments in oil and ammoniacal solutions to further improve their physical characteristics. The resulting aged and gelled spheres are then washed and dried at a relatively low temperature of about 80° to 260° C. and then calcined at a temperature of about 455° to 705° C. for a period of about 1 to about 20 hours. This treatment effects conversion of the hydrogel to the corresponding crystalline gamma alumina comprising a dilute amount of phosphorus.

A preferred form of carrier material is a cylindrical extrudate, preferably prepared by adding and mixing the alumina powder with water and suitable peptizing agents such as HCl until extrudable dough is formed. Preferably the peptizing agent comprises a combination of nitric acid with a dilute amount of phosphoric acid selected to provide a desired phosphorus level in a finished catalyst less than 0.4 mass-% calculated on an elemental basis, with a phosphorus range of 0.05 to 0.35 mass-% giving best results for phosphorus when used as a stabilizing component. Boric acid may be substituted in part or in whole for the phosphoric acid. The amount of water added to form the dough is typically sufficient to give a loss on ignition (LOI) at 500° C. of about 45 to 65 mass-%, with a value of 55 mass-% being preferred. The resulting dough is extruded through a suitably sized die to form extrudate particles. These particles are then dried at a temperature of about 260° to about 427° C. for a period of about 0.1 to 5 hours to form the extrudate particles. It is preferred that the refractory inorganic oxide comprises phosphorus and substantially pure alumina. A typical substantially pure alumina has been characterized in U.S. Pat. Nos. 3,852,190 and 4,012,313 as a by-product from a Ziegler higher alcohol synthesis reaction as described in Ziegler's U.S. Pat. No. 2,892,858.

An essential ingredient of a reforming catalyst is a dispersed platinum-group component. This platinum-group component may exist within the final catalytic composite as a compound such as an oxide, sulfide, halide, oxyhalide, etc., in chemical combination with one or more of the other ingredients of the composite or as an elemental metal. It is preferred that substantially all of this component is present in the elemental state and is uniformly dispersed within the support material. This component may be present in the final catalyst composite in any amount that is catalytically effective, but relatively small amounts are preferred. Of the platinum-group metals, which can be dispersed on the desired support, preferred metals are rhodium, palladium, platinum, and platinum being most preferred. Platinum generally comprises about 0.01 to about 2 mass-% of the final catalytic composite, calculated on an elemental basis. Excellent results are obtained when the catalyst contains about 0.05 to about 1 mass-% of platinum.

This platinum component may be incorporated into the catalytic composite in any suitable manner, such as coprecipitation or cogelation, ion-exchange, or impregnation, in order to effect a uniform dispersion of the platinum component within the carrier material. The preferred method of preparing the catalyst involves the utilization of a soluble, decomposable compound of platinum to impregnate the carrier material. For example, this component may be added to the support by commingling the latter with an aqueous solution of chloroplatinic acid. Other water-soluble compounds of platinum may be employed in impregnation solutions and include ammonium chloroplatinate, bromoplatinic acid, platinum dichloride, platinum tetrachloride hydrate, platinum dichlorocarbonyl dichloride, dinitrodiaminoplatinum, etc. The utilization of a platinum chloride compound, such as chloroplatinic acid, is preferred since it facilitates the incorporation of both the platinum component and at least a minor quantity of the halogen component in a single step. Best results are obtained in the preferred impregnation step if the platinum compound yields anionic complexes containing platinum in acidic aqueous solutions. Hydrogen chloride or the like acid is also generally added to the impregnation solution in order to facilitate the incorporation of the halogen component and the distribution of the metallic component. In addition, it is generally preferred to impregnate the carrier material after it has been calcined in order to minimize the risk of washing away the valuable platinum compounds; however, in some cases, it may be advantageous to impregnate the carrier material when it is in a gelled state.

Rhenium is an optional metal modifier of the catalyst. The platinum and rhenium components of the terminal catalytic composite may be composited with the refractory inorganic oxide in any manner which results in a preferably uniform distribution of these components such as coprecipitation, cogelation, coextrusion, ion exchange or impregnation. Alternatively, non-uniform distributions such as surface impregnation are within the scope of the present invention. The preferred method of preparing the catalytic composite involves the utilization of soluble decomposable compounds of platinum and rhenium for impregnation of the refractory inorganic oxide in a relatively uniform manner. For example, the platinum and rhenium components may be added to the refractory inorganic oxide by commingling the latter with an aqueous solution of chloroplatinic acid and thereafter an aqueous solution of perrhenic acid. Other water-soluble compounds or complexes of platinum and rhenium may be employed in the impregnation solutions. Typical decomposable rhenium compounds which may be employed include ammonium perrhenate, sodium perrhenate, potassium perrhenate, potassium rhenium oxychloride, potassium hexachlororhenate (IV), rhenium chloride, rhenium heptoxide, and the like compounds. The utilization of an aqueous solution of perrhenic acid is preferred in the impregnation of the rhenium component.

As heretofore indicated, any procedure may be utilized in compositing the platinum component and rhenium component with the refractory inorganic oxide as long as such method is sufficient to result in relatively uniform distributions of these components. Accordingly, when an impregnation step is employed, the platinum component and rhenium component may be impregnated by use of separate impregnation solutions or, as is preferred, a single impregnation solution comprising decomposable compounds of platinum component and rhenium component. It should be noted that irrespective of whether single or separate impregnation solutions are utilized, hydrogen chloride, nitric acid, or the like acid may be also added to the impregnation solution or solutions in order to further facilitate uniform distribution of the platinum and rhenium components throughout the refractory inorganic oxide. Additionally, it should be indicated that it is generally preferred to impregnate the refractory inorganic oxide after it has been calcined in order to minimize the risk of washing away valuable platinum and rhenium compounds; however, in some cases, it may be advantageous to impregnate refractory inorganic oxide when it is in a gelled, plastic dough or dried state. If two separate impregnation solutions are utilized in order to composite the platinum component and rhenium component with the refractory inorganic oxide, separate oxidation and reduction steps may be employed between applications of the separate impregnation solutions. Additionally, halogen adjustment steps may be employed between applications of the separate impregnation solutions. Such halogenation steps will facilitate incorporation of the catalytic components and halogen component into the refractory inorganic oxide. Final catalyst halogen, preferably chloride, content will suitably be between 0.01 wt-% and 10 wt-%, with a range of about 0.1 wt-% to about 2.0 wt-% being preferred.

Irrespective of its exact formation, the dispersion of platinum component and rhenium component must be sufficient so that the platinum component comprises, on an elemental basis, from about 0.01 to about 2 mass-% of the finished catalytic composite. Additionally, the rhenium component, if present, will comprise on an elemental basis from about 0.01 to about 5 mass-% of the finished composite.

In addition to, or instead of, the rhenium catalytic component described above, other components may be added to the catalyst. For example, a modifier metal selected from the group consisting of tin, germanium, lead, indium, gallium, iridium, lanthanum, cerium, cobalt, nickel, iron and mixtures thereof may be added to the catalyst. Such metal modifiers are added by the same procedure as rhenium above and in any sequence although with not necessarily the same results. Thus the modifier metal components, if present, will comprise on an individual elemental basis from about 0.01 to about 5 mass-% of the finished composite One particular method of evaporative impregnation involves the use of a steam-jacketed rotary dryer. In this method the support is immersed in the impregnating solution which has been placed in the dryer and the support is tumbled by the rotating motion of the dryer. Evaporation of the solution in contact with the tumbling support is expedited by applying steam to the dryer jacket. The impregnated support is then dried at a temperature of about 60° to about 300° C. and then calcined at a temperature of about 300° to about 850° C. for a time of about 30 minutes to about 18 hours to give the calcined catalyst. Finally, the calcined catalyst is reduced by heating the catalyst under a reducing atmosphere, preferably dry hydrogen, at a temperature of about 300° to about 850° C. for a time of about 30 minutes to about 18 hours. This ensures that the metal is in the metallic or zerovalent state.

The catalyst system of the present invention has particular utility as a hydrocarbon conversion catalyst system. The hydrocarbon that is to be converted is contacted with the catalyst system at hydrocarbon-conversion conditions, which include a temperature of from 40° to 1000° C., a pressure of from atmospheric to 200 atmospheres absolute (100 kPa to 20,000 kPa) and liquid hourly space velocities from about 0.1 to 100 $hr^{-1}$. The catalyst system is particularly suitable for catalytic reforming of gasoline-range feedstocks, and also may be used for, inter alia, dehydrocyclization, isomerization of aliphatics and aromatics, dehydrogenation, hydro-cracking, disproportionation, dealkylation, alkylation, transalkylation, and oligomerization.

In the preferred catalytic reforming embodiment, hydrocarbon feedstock and a hydrogen-rich gas are preheated and charged to a reforming zone containing typically two to five reactors in series. The first catalyst of the catalyst system of the invention is placed in the front reactors of the series in order to take advantage of the lower chloride retention associated with the presence of a stabilizer component and the relatively lower average bed temperatures generally present in the more highly endothermic front reactors. The first catalyst avoids unnecessary yield loss due to cracking reactions associated with high chloride content and improves total $C_5^+$ yields from the total reforming zone. Alternatively, the first catalyst is placed in the top part of the reactor or the part of the reactor nearest the feed inlet. Thus, for example, in a radial reactor the first catalyst is placed radially in front of the second catalyst, or in a downflow reactor the first catalyst is layered above a second catalyst. Lower catalyst chloride levels are desired at the reactor inlet where the temperature is high in order to reduce undesired cracking reactions such as the cracking of hydrocarbons to light end gas. As the temperature drops in a reactor due to endothermic reforming reactions, higher chloride levels on a catalyst are utilized to increase activity at the lower temperatures. The variation of chloride is achieved within the catalyst beds or between the reactors by the loading of several catalysts that contain alumina with different chloride retention properties.

Suitable heating means are provided between reactors to compensate for the net endothermic heat of reaction in each of the reactors. Reactants may contact the catalyst system in individual reactors in upflow, downflow, or radial flow fashion, with the radial flow mode being preferred. The catalyst system is contained in a fixed-bed system and/or in a moving-bed system with associated continuous catalyst regeneration. One exemplary reforming system will use moving bed tail reactors that operate with higher chloride levels than fixed bed lead reactors. The lead reactors are operated at lower chloride levels with the use of catalyst having lower chloride retention properties in order to prevent high cracking reactions and reduced $C_5^+$ yields. The first catalyst will be loaded in the fixed bed reactors and contain the stabilizing component of the present invention, while the second catalyst will be loaded in the moving bed reactors and have a different composition. Such a reforming process system benefits from the catalyst system of the invention due to the flexibility to select catalysts that can balance different chloride retention properties and environments between the fixed and moving bed reactors, especially when a common recycle gas system transfers chloride and water between the reactors.

Alternative approaches to reactivation of deactivated catalyst are well known to those skilled in the art, and include semi-regenerative operation in which the entire unit is shut down for catalyst regeneration and reactivation or swing-reactor operation in which an individual reactor is isolated from the system, regenerated and reactivated while the other reactors remain on-stream. Continuous catalyst regeneration in conjunction with a moving-bed system is disclosed, inter alia, in U.S. Pat. Nos. 3,647,680; 3,652,231; 3,692,496 and 4,832,921, all of which are incorporated herein by reference.

Effluent containing at least part of the aromatized products from the reforming zone is passed through a cooling means to a separation zone, typically maintained at about 0° to 65° C., wherein a hydrogen-rich gas is separated from a liquid stream commonly called "unstabilized reformate". The resultant hydrogen stream can then be recycled through suitable compressing means back to the reforming zone. The liquid phase from the separation zone is typically withdrawn and processed in a fractionating system in order to adjust the butane concentration, thereby controlling front-end volatility of the resulting reformate.

Reforming conditions applied in the reforming process of the present invention include a pressure selected within the range of about 100 kPa to 7 MPa (abs). Particularly good results are obtained at low pressure, namely a pressure of about 350 to 4500 kPa (abs). Reforming temperature is in the range from about 315° to 600° C., and preferably from about 425° to 565° C. As is well known to those skilled in the reforming art, the initial selection of the temperature within this broad range is made primarily as a function of the desired octane of the product reformate considering the characteristics of the charge stock and of the catalyst. Ordinarily, the temperature then is thereafter slowly increased during the run to compensate for the inevitable deactivation that occurs to provide a constant octane product. Sufficient hydrogen is supplied to provide an amount of about 1 to about 20 moles of hydrogen per mole of hydrocarbon feed entering the reforming zone, with excellent results being obtained when about 2 to about 10 moles of hydrogen are used per mole of hydrocarbon feed. Likewise, the liquid hourly space velocity (LHSV) used in reforming is selected from the range of about 0.1 to about 20 $hr^{-1}$, with a value in the range of about 1 to about 5 $hr^{-1}$ being preferred.

The hydrocarbon feedstock that is charged to this reforming system is preferably a naphtha feedstock comprising naphthenes and paraffins that boil within the gasoline range. The preferred feedstocks are naphthas consisting principally of naphthenes and paraffins, although, in many cases, aromatics also will be present. This preferred class includes straight-run gasolines, natural gasolines, synthetic gasolines, and the like. It is also frequently advantageous to charge thermally or catalytically cracked gasolines, partially reformed naphthas, or dehydrogenated naphthas. Mixtures of straight-run and cracked gasoline-range naphthas can also be used to advantage. In some cases, it is also advantageous to process pure hydrocarbons or mixtures of hydrocarbons that have been recovered from extraction units—for example, raffinates from aromatics extraction or straight-chain paraffins—which are to be converted to aromatics.

The feedstock may contain a dilute amount of equivalent chloride; typically, less than 5 wt-ppm, and preferably less than 0.5 wt-ppm. Chloride may also be injected continuously, semi-continuously, or periodically in the form of any known organic or inorganic chloride species to any or all of the reactors accordingly to the methods disclosed inter alia, in U.S. Pat. Nos. 4,832,821 and 6,558,532, both of which are incorporated herein by reference. Catalyst chloride levels may also be adjusted during regeneration steps well known in the art for fixed bed, cyclic, or moving bed reactors such as disclosed inter alia, in U.S. Pat. Nos. 3,864,240 and 5,837,636, both of which are incorporated herein by reference.

It is generally preferred to utilize the present invention in a substantially water-free environment. Essential to the achievement of this condition in the reforming zone is the control of the water level present in the feedstock and the hydrogen stream that is being charged to the zone. Best results are ordinarily obtained when the total amount of water entering the conversion zone from any source is held to a level less than 50 ppm and preferably less than 20 ppm, expressed as weight of equivalent water in the feedstock. In general, this can be accomplished by careful control of the water present in the feedstock and in the hydrogen stream. The feedstock can be dried by using any suitable drying means known to the art such as a conventional solid adsorbent having a high selectivity for water; for instance, sodium or calcium crystalline aluminosilicates, silica gel, activated alumina, molecular sieves, anhydrous calcium sulfate, high surface area sodium, and the like adsorbents. Similarly, the water content of the feedstock may be adjusted by suitable stripping operations in a fractionation column or like device. In some cases, a combination of adsorbent drying and distillation drying may be used advantageously to effect almost complete removal of water from the feedstock. Preferably, the feedstock is dried to a level corresponding to less than 2 ppm of $H_2O$ equivalent.

It is preferred to maintain the water content of the hydrogen stream entering the hydrocarbon conversion zone at a level of about 10 to 30 vol-ppm or less. In the cases where the water content of the hydrogen stream is above this range, this can be conveniently accomplished by contacting the hydrogen stream with a suitable desiccant such as those mentioned above at conventional drying conditions.

It is a preferred practice to use the present invention in a substantially sulfur-free environment. Any control means known in the art may be used to treat the naphtha feedstock which is to be charged to the reforming reaction zone. For example, the feedstock may be subjected to adsorption processes, catalytic processes, or combinations thereof. Adsorption processes may employ molecular sieves, high surface area silica-aluminas, carbon molecular sieves, crystalline aluminosilicates, activated carbons, high surface area metallic containing compositions, such as nickel or copper and the like. It is preferred that these feedstocks be treated by conventional catalytic pre-treatment methods such as hydrorefining, hydrotreating, hydrodesulfurization, etc., to remove substantially all sulfurous, nitrogenous and water-yielding contaminants therefrom, and to saturate any olefins that may be contained therein. Catalytic processes may employ traditional sulfur reducing catalyst formulations known to the art including refractory inorganic oxide supports containing metals selected from the group comprising Group VI-B(6), Group II-B(12), and Group VIII(IUPAC 8-10) of the Periodic Table.

The following examples are presented only to illustrate certain specific embodiments of the invention, and should not be construed to limit the scope of the invention as set forth in the claims. There are many possible other variations, as those of ordinary skill in the art will recognize, within the scope of the invention.

EXAMPLE 1

To demonstrate the effect of chloride level of reforming catalyst performance, an extruded catalyst comprising gamma alumina was prepared with 0.25 wt-% platinum metal and 0.25 wt-% rhenium metal using techniques well known in the art. The catalyst was finished at two different chloride levels. Catalyst A was finished at a chloride level of 1.08 wt-% chloride. Catalyst B was finished at a chloride level of 1.40 wt-% chloride. Both catalysts were evaluated in a cylindrical downflow catalytic naphtha reforming pilot plant operating at a pressure of 21 $kg/cm^2$ (300 psig), a liquid hourly space velocity of 2.0 $hr^{-1}$, and hydrogen to hydrocarbon ratio of 10 to 1, and a target research octane number of 95. The results showed that at a catalyst life of about 0.53 $m^3/kg$ (1.5 barrel of feed per pound of catalyst), catalyst A attained an average reactor temperature of about 514° C. (958° F.) and a $C_5^+$ liquid yield of about 79.5 vol-% based on total feed, and catalyst B attained an average reactor temperature of about 504° C. (940° F.) and a $C_5^+$ yield of about 77.0 vol-%. Hydrogen yield with catalyst A was increased by about 10.4 $nM^3/M^3$ (60 SCFB) as compared to catalyst B. Thus, a change in chloride level on a reforming catalyst was determined to change yields and activity. Decreased yields were due to increased cracking to light end hydrocarbons ($C_4^-$) that also consumed valuable hydrogen.

EXAMPLE 2

Phosphorus was added to the support as part of the forming process called extrusion. A catalyst sample was prepared by adding phosphoric acid to the peptizing solution nitric acid such that the total moles of acid were approximately equivalent to 2 mass-% of the alumina powder. Thus, the amount of nitric acid used was decreased by the amount of phosphoric acid so that the total moles of acid remained about the same. Alumina powder was a blend of commercially available trade name CATAPAL B and trade name VERSAL 250. The solution was added to the alumina powder with an amount of phosphoric acid corresponding to 0.4 wt-% phosphorus in the support, but where the balance of peptizing agent with nitric acid and maintained about a 2 mass-% ratio to the alumina.

After peptizing, the dough was mixed and extruded through a die plate to form extrudate particles. The extrudate particles were calcined at about 650° C. for about 2 hours. Thus, catalyst C was a reference without any phosphorus and catalyst D had 0.4 wt-%.

EXAMPLE 3

In order to gauge the effect of stabilizer content on catalyst surface area stability, the various catalysts were subjected to a hydrothermal treatment. This treatment comprised loading the catalysts into a tube furnace and subjecting them to conditions including a 725° C. temperature and 40 mol-% steam in 1000 cc/min air flow for 1, 3, or 6 hours. The surface area of the catalysts after hydrothermal treatment was as follows: catalyst C was 176 $m^2/g$ after 1 hour, catalyst C was 158 $m^2/g$ after 3 hours, and catalyst C was 150 $m^2/g$ after 6 hours. Catalyst D was 203 $m^2/g$ after 1 hour, catalyst D was 185 $m^2/g$ after 3 hours, and catalyst D was 175 $m^2/g$ after 6 hours.

EXAMPLE 4

Higher amounts of phosphorus, or any other stabilizer component, in an alumina support affect the ability of the catalyst to adsorb and retain chloride. A critical property for reforming catalysts is to keep chloride while losing surface area as the catalyst ages.

In order to demonstrate the ability of supports to retain different levels of chloride, catalysts C and D after each hydrothermal treatment conducted in Example 3, were subsequently chlorided under the following identical conditions. The catalysts were treated in a flowing air stream containing hydrochloric acid and water such that a molar ratio of 55.5$H_2O$/Cl was obtained at a temperature of 525° C. until reaching equilibrium levels of chloride adsorption. The equilibrium chloride adsorption after each treatment was as follows: catalyst C was 1.07 wt-% chloride (on support with 176 $m^2/g$ after 1 hour steaming), catalyst C was 0.95 wt-% chloride (on support with 158 $m^2/g$ after 3 hours steaming), and catalyst C was 0.95 wt-% chloride (on support with 150 $m^2/g$ after 6 hours steaming). In contrast, catalyst D was 0.98 wt-% chloride (on support with 203 $m^2/g$ after 1 hour steaming), catalyst D was 0.90 wt-% chloride (on support with 185 $m^2/g$ after 3 hours steaming), and catalyst D was 0.83 wt-% chloride (on support with 175 $m^2/g$ after 6 hours steaming). Thus, the results indicated that as surface areas declined with more steaming time on both catalysts C and D, the chloride levels on catalyst C remain higher than the chloride levels on catalyst D.

EXAMPLE 5

In order to compare the performance of the phosphorus containing support against alumina without phosphorus, two additional catalyst samples were created using the same extrusion method according to Example 2. Catalyst E had no phosphorus while catalyst F had 0.2 wt-% phosphorus.

In order to compare the performance between catalyst E and catalyst F under naphtha reforming conditions, both catalysts were loaded with 0.3 wt-% platinum. The catalysts were individually placed in a rotary evaporator. A solution comprising deionized water, hydrochloric acid, chloroplatinic acid was added to the rotary evaporator and temperature was raised to 100° C. and the support rolled for 5 hours. Next the impregnated catalysts were heated to a temperature of 525° C. in dry air. When the temperature was reached, an air stream containing HCl and $Cl_2$ was flowed through the catalysts for 6 hours. Finally, the catalysts were reduced by flowing pure hydrogen over the catalyst at a temperature of 510° C. for 2.5 hours. Analysis of catalyst E showed it to contain 0.85 wt-% chloride and catalyst F had 0.89 wt-% chloride.

Both catalysts were loaded into downflow pilot plant reactors and individually tested by contact with a mid-range naphtha feedstock under conditions of about 1900 kPa, 1.8 liquid hourly space velocity, 2.0 hydrogen to hydrocarbon recycle gas ratio, with a target product octane of about 99. Catalyst E attained about 79.9 wt-% $C_5^+$ yield at about 100 hours on stream, which compared to catalyst F that attained about 80.4 wt-% $C_5^+$ yield for about the same time. Both catalysts attained about the same activity of almost 511° C. average reactor block temperature.

Therefore, naphtha reforming pilot plant testing data clearly indicates that catalyst F with 0.2 wt-% phosphorus operated at equivalent activity and better yields than a reference catalyst E prepared without phosphorus incorporation.

What is claimed is:

1. A reforming process comprising contacting a naphtha feedstock with a first catalyst under reforming conditions to produce a first product stream, and contacting at least a portion of the first product stream with at least a second catalyst under reforming conditions to provide an aromatized product with increased octane over the feedstock; the first catalyst comprising an alumina support having dispersed thereon a platinum group component, a chloride component, and a stabilizer component selected from the group consisting of phosphorus, boron, titanium, silicon, zirconium and mixtures thereof, present in an amount from greater than 0 to about 1 wt-% of the catalyst calculated on an elemental basis; the second catalyst comprising an alumina support having dispersed thereon a platinum group component, a chloride component, and an optional stabilizer component, characterized in that the amount of stabilizer component, if present, in the second catalyst is an effective amount different from the first catalyst wherein the second catalyst is characterized after steaming fresh catalyst with air comprising about 40 mol-% water for about 6 hours at about 725° C. to produce steamed second catalyst, the steamed second catalyst has an equilibrium level of chloride adsorption greater than about 0.8 wt-% as determined under a flowing air stream containing hydrochloric acid and water with a molar ratio of 55.5 $H_2O$/Cl and a temperature of 525° C.

2. The process of claim 1 wherein fresh catalyst is catalyst prior to use in process and has initial surface area from 250 to 185 $m^2/g$.

3. The process of claim 1 wherein the reforming conditions comprise a pressure of about 100 kPa to about 7 MPa (abs), a temperature of about 315° to about 600° C., and a liquid hourly space velocity of about 0.1 to about 20 $hr^{-1}$.

4. The process of claim 3 wherein the reforming conditions further comprise a substantially water-free environment.

5. The process of claim 1 wherein the stabilizer component in the first catalyst is present in an amount from about 0.05 to about 0.5 wt-% calculated on an elemental basis.

6. The process of claim 5 wherein the stabilizer component in the first catalyst is present in an amount from 0.05 to 0.35 wt-% calculated on an elemental basis.

7. The process of claim 1 wherein the platinum group component is platinum and is present in either catalyst in an amount from about 0.01 to about 2.0 wt-% calculated on an elemental basis.

8. The process of claim 1 wherein the chloride component is present in either catalyst in an amount from about 0.1 to about 2.0 wt-% calculated on an elemental basis.

9. The process of claim 1 wherein the naphtha feedstock is substantially sulfur free.

10. The process of claim 1 wherein either catalyst is further characterized as having a surface area greater than about 130 $m^2/g$.

11. The process of claim 1 further characterized wherein the second catalyst is contained in a reactor with at least the first catalyst.

12. The process of claim 1 further characterized wherein the first catalyst is a fixed-bed catalyst and the second catalyst is a moving-bed catalyst contained in a separate reactor.

13. A reforming process comprising contacting a substantially sulfur free naphtha feedstock with a fixed-bed catalyst under first reforming conditions to produce a fixed-bed product stream, and contacting at least a portion of the fixed-bed product stream with a moving-bed catalyst under second reforming conditions to provide an aromatized product with increased octane over the feedstock, the fixed-bed catalyst comprising an alumina support having dispersed thereon a platinum group component, a chloride component, and a stabilizer component selected from the group consisting of phosphorus, boron, titanium, silicon, zirconium and mixtures thereof, present in an amount from greater than 0 to about 1 wt-% of the catalyst calculated on an elemental basis; the moving-bed catalyst comprising an alumina support having dispersed thereon a platinum group component, a chloride component, and an optional stabilizer component, characterized in that the amount of stabilizer component, if present, in the moving-bed catalyst is an effective amount different from the fixed-bed catalyst and characterized after steaming fresh catalyst with air comprising about 40 mol-% water for about 6 hours at about 725° C. to produce steamed moving-bed catalyst, the steamed moving-bed catalyst has an equilibrium level of chloride adsorption greater than about 0.8 wt-% as determined under a flowing air stream containing hydrochloric acid and water with a molar ratio of 55.5 $H_2O/Cl$ and a temperature of 525° C.

14. The process of claim 13 wherein the reforming conditions comprise a pressure of about 100 kPa to about 7 MPa (abs), a temperature of about 315° to about 600° C., a liquid hourly space velocity of about 0.1 to about 20 $hr^{-1}$, and a substantially water-free environment.

15. A naphtha catalyst system comprising a first catalyst and at least a second catalyst, the first catalyst comprising an alumina support having dispersed thereon a platinum group component, a chloride component, and a stabilizer component selected from the group consisting of phosphorus, boron, titanium, silicon, zirconium and mixtures thereof, present in an amount from greater than 0 to about 1 wt-% of the catalyst calculated on an elemental basis; the second catalyst comprising an alumina support having dispersed thereon a platinum group component, a chloride component, and an optional stabilizer component, characterized in that the amount of stabilizer component, if present, in the second catalyst is an effective amount different from the first catalyst the second catalyst is further characterized after steaming fresh catalyst with air comprising about 40 mol-% water for about 6 hours at about 725° C. to produce steamed second catalyst, the steamed second catalyst has an equilibrium level of chloride adsorption greater than about 0.8 wt-% as determined under a flowing air stream containing hydrochloric acid and water with a molar ratio of $55.5H_2O/Cl$ and a temperature of 525° C.

16. The catalyst system of claim 15 wherein fresh catalyst is catalyst prior to use in process and has initial surface area from 250 to 185 $m^2/g$.

17. The catalyst system of claim 15 wherein the stabilizer component in the first catalyst is present in an amount from about 0.05 to about 0.5 wt-% calculated on an elemental basis.

18. The catalyst system of claim 17 wherein the stabilizer component in the first catalyst is present in an amount from 0.05 to 0.35 wt-% calculated on an elemental basis.

19. The catalyst system of claim 15 wherein the platinum group component is platinum and is present in either catalyst in an amount from about 0.01 to about 2.0 wt-% calculated on an elemental basis.

20. The catalyst system of claim 15 wherein the chloride component is present in either catalyst in an amount from about 0.1 to about 2.0 wt-% calculated on an elemental basis.

21. The catalyst system of claim 15 wherein either catalyst is further characterized as having a surface area greater than about 130 m2/g.

22. The catalyst system of claim 15 wherein either catalyst further comprises a metal modifier component selected from the group consisting of tin, rhenium, germanium, lead, indium, gallium, iridium, lanthanum, cerium, cobalt, nickel, iron, and mixtures thereof.

23. The catalyst system of claim 22 wherein the metal modifier component is present in either catalyst in an amount from about 0.01 to about 5.0 wt-% calculated on an elemental basis.

* * * * *